United States Patent [19]

Martin

[11] 4,344,923

[45] Aug. 17, 1982

[54] IN-SITU LEACHING

[75] Inventor: Brian Martin, Bedford, England

[73] Assignee: Interox Chemicals Limited, London, England

[21] Appl. No.: 81,133

[22] Filed: Oct. 2, 1979

[30] Foreign Application Priority Data

Oct. 21, 1978 [GB] United Kingdom ..... 41493/78

[51] Int. Cl.[3] ..... C01G 43/00; E21C 41/14

[52] U.S. Cl. ..... 423/20; 299/4; 299/5; 423/18

[58] Field of Search ..... 423/18, 20; 264/4, 5; 299/4, 5

[56] References Cited

U.S. PATENT DOCUMENTS 3,309,141 3/1967 Fitch et al. ..... 423/20 X 4,229,422 10/1980 Covington et al. ..... 423/18

FOREIGN PATENT DOCUMENTS 555622 4/1958 Canada ..... 423/18

2389679 12/1978 France ..... 423/20

*Primary Examiner*—Deborah L. Kyle

*Attorney, Agent, or Firm*—Larson and Taylor

[57] ABSTRACT

The present invention relates to in-situ leaching of uranium, particularly employing an acidic leach liquor containing an oxidant, and especially in respect of ores containing significant amounts of transition metals that act as catalysts for peroxidant decomposition. When hydrogen peroxide is used as oxidant under such conditions it decomposes leading to the formation of gas bubbles and exacerbation of ore-blinding, and a reduction in the efficiency of extraction of uranium.

The present invention employs peroxymonosulphuric acid as oxidant and thereby ameliorates the problems aforesaid. Preferably, additionally, sulphuric acid is present in the leach liquor and in many preferred embodiments the peroxymonosulphuric acid concentration is from 0.001 to 0.03 moles/liter and the sulphuric acid from 0.025 to 0.075 moles/liter.

7 Claims, No Drawings

IN-SITU LEACHING

The present invention relates to a process for the in-situ leaching of uranium employing an acidic leach liquor.

As a result of the increasing demand for uranium for use in nuclear electricity generating stations, in recent years the attention of the uranium mining industry has turned towards less accessible or leaner ores, and in particular towards the use of in-situ leaching methods, i.e. methods in which one or more wells are drilled into the native ore body located underground, through which wells a suitable leach liquor is first injected and then recovered. The leach liquors that have been employed hitherto have fallen into two general categories, depending upon the nature of the native uranium-containing ore. Thus, where the native ore contains a significant amount of a carbonate mineral, the leach liquor is normally a dilute solution of an alkali metal or ammonium carbonate/bicarbonate, such as described in U.S. Pat. No. 2,818,240. The second class of reagents comprises mineral acids and in particular sulphuric acid and it will be recognised that acid leaching is economically feasible only where the native ore contains only a little acid-consuming gangue, of which one major component is carbonate minerals. Now, in many of the ores that are leached in situ, a substantial proportion if not most of the uranium is present as uranium (IV) which is substantially insoluble in acid or alkaline solution and therefore in order to convert the uranium to the soluble uranium (VI) state, oxygen, air or hydrogen peroxide as oxidant has been incorporated in the leach liquor, as described in e.g. U.S. Pat. No. 3,792,903 and 4,082,359. Although the aforementioned U.S. patents refer to the incorporation of oxidant in alkaline leaching liquors, the same oxidants could in theory also be included in the acid leaching liquors.

A further problem associated with acid leaching, and as described by Shiou-Chuan Sun and J. W. Fetterman in their article entitled "Acid leaching from some South Dakota Lignites" in Indiana Journal of Technology, 1963, Volume 1, No. 3 pages 120–3, is that of a poor selectivity for dissolving metals, and this manifests itself by the leaching into solution of other transition metal ions such as vanadium that in many cases are also present in the native uranium ore. Such transition metal ions are effective catalysts for the decomposition of hydrogen peroxide, thereby generating oxygen bubbles in the leach liquor whilst it is in contact with the native ore or in the case of recycled liquor, even before such contact can occur. It will therefore be recognised that in practice use of all the three oxidants often employed, namely air, oxygen, and hydrogen peroxide can result in the presence of gaseous bubbles in the leach liquor when it is underground. Thus, whilst the presence of the oxidant is essential for a reasonable proportion of the uranium to be extracted from the ore reasonably quickly, its presence can contribute to and exacerbate a phenomenon described as ore-blinding, that is to say various of the pores and channels through the ore being obstructed by gaseous bubbles which prevent the passage of leaching liquor into and through those pores and channels. The net effect of blinding is to reduce the rate of flow of leaching liquor from injection to recovery wells and to reduce the ability of the leach liquor to penetrate throughout the ore body to extract the uranium. Naturally the problem of ore-blinding can be reduced by downward adjustment of for example hydrogen peroxide concentration in the leach liquor, but of course this leads to a lower concentration of Uranium in the pregnant liquor, a correspondingly increased period for the extraction of Uranium from the ore and therefore increases operating costs.

According to the present invention there is provided a process for the in-situ leaching of uranium comprising the steps of:

(a) drilling at least one injection well and at least one production well offset from the injection well into an ore body located underground containing uranium and at least one transition metal;

(b) injecting a leaching solution containing peroxymonosulphuric acid into the uranium-containing ore body through the injection wells; and (c) recovering from the production wells a solution containing dissolved uranium salts formed by passage of the leaching solution containing peroxymonosulphuric acid through the uranium-containing ore body.

It will be recognised that whilst the process of the present invention is particularly suitable for and particularly directed towards the leaching of uranium from ores containing not more than a small proportion of acid reacting minerals like carbonate, e.g. up to 0.5% by weight, the amount of gangue is however only one of the factors which determine whether or not the process is economically viable, others being the price obtained for the uranium and any other metal extracted and separated net costs of providing the leaching reagents at the point of use and of drilling and where necessary completing the injection and recovery wells. It will be recognised that in situ mining is particularly of value where the ore bed is primarily a sandstone in view of the permeability characteristics of sandstone, but the technique can also be applied to ores of similar permeability, or ores permeability of which has been increased by in situ fracturing.

Acidic solutions for the in situ leaching of uranium are normally dilute, frequently falling in the range of from 0.01 to 0.25 moles per liter of acid in the injected solution. Since peroxymonosulphuric acid is itself an acid, it will be recognised that the entire acid content of the leaching solution can be provided by peroxymonosulphuric acid, if desired, but in practice this is not normally effected, because a proportion of the acid is consumed by the acid-reacting gangue. Even when the gangue is present in an amount of less than 0.5% by weight of the ore being contacted with the acid, it will be recognised that the proportion of acid consumed by the gangue is often of the same order as the amount consumed by reaction in the uranium-containing mineral present in the ore. Advantageously, the liquor contains a significant proportion of a mineral acid, especially sulphuric acid which as a strong acid tends to react with the acid-consuming gangue in preference to the peroxymonosulphuric acid which is only a weak acid. Consequently, ensuring that sulphuric acid remains in the leaching liquor in addition to the peroxymonosulphuric acid, a greater proportion of the peroxymonosulphuric acid can be employed for the beneficial extraction of uranium instead of being consumed by wasteful reaction with the gangue. There is an additional reason for incorporating sulphuric acid as part of the overall acidity of the solution, and the reason is that in some, but not all of the ores, a proportion of uranium in the ore is present in the hexavalent state and thus can be leached out using solely sulphuric acid obeying the overall equation (1):

$$UO_3+H_2SO_4 \rightarrow UO_2SO_4+H_2O. \quad (1)$$

Peroxymonosulphuric acid advantageously extracts tetravalent uranium from the ore obeying the overall reaction (2):

$$UO_2+H_2SO_5 \rightarrow UO_3+H_2SO_4 \rightarrow UO_2SO_4+H_2O. \quad (2)$$

Part of the Uranium may be oxidised directly and part by an indirect route e.g by the oxidation of ferrous ions to ferric ions with the peroxymonosulphuric acid followed by reaction between the ferric ions and Uranium. It will be recognised that when peroxymonosulphuric acid is employed as an oxidant, one of the resultant products is sulphuric acid, so that no addition of sulphuric acid is necessary for the extraction of uranium, but it will be recognised that it is economically desirable to employ as small a proportion of peroxymonosulphuric acid as possible. Hence for large scale use, the peroxymonosulphuric acid is most conveniently produced from sulphuric acid or oleum. In view of the above, the mole ratio of sulphuric acid to peroxymonosulphuric acid is often selected in the range of from 100:1 to 1:1, notwithstanding the fact that the tetravalent uranium proportion in the ore is often substantially greater than 50% of uranium, and can indeed by substantially 100%, as measured by analysing samples of the native ore. For extraction from many ores, the concentration of sulphuric acid in solution is preferably from 0.02 to 0.1 moles per liter and the peroxymonosulphuric acid concentration preferably from 0.0005 to 0.1 moles per liter. For some ores, the sulphuric acid concentration is advantageously in the range of from 0.025 moles per liter to 0.075 moles per liter and that of peroxymonosulphuric acid in the range of from 0.001 moles per liter to 0.03 moles per liter.

In many ways the process according to the present invention resembles that in which uranium is leached with a sulphuric acid solution containing hydrogen peroxide. However, it will be understood that a solution of peroxymonosulphuric acid cannot be obtained merely by forming a dilute solution of hydrogen peroxide in sulphuric acid. Under such conditions, the equilibrium amount of peroxymonosulphuric acid formed is for practical purposes nil. Now, by the use of the invention leaching solutions, uranium can be extracted more readily from ores which contain significant amounts of other transition metals which would otherwise act as a catalyst for the decomposition of active oxygen-containing oxidants. Of particular note is vanadium which is an especially active catalyst for the decomposition of hydrogen peroxide, and which is frequently extracted into solutions together with the uranium. The effect of hydrogen peroxide decomposition is the immediate formation of oxygen which, as has been explained before, can form bubbles and contribute to and exacerbate blinding and a decrease in permeability of the native ore. A consequence of blinding is that the penetration of the ore by the leach liquor is retarded and rendered less uniform. A second consequence of this decomposition is of that the removal of active oxygen from solution means that the oxidant is not transported through the ore in the leach liquor to the same extent as would be the case if it remained in solution. Thus, not only is the penetration of the leach liquor retarded, but the oxidation power of the leach liquor diminishes more rapidly as liquor penetrates the ore with the result that in the absence of any other measures the zone around the recovery well is contacted only with sulphuric acid rather than oxidant containing acid. Thus, the net effect of peroxide decomposition is not only the less rapid but also the less complete extraction of uranium from the ore. By the use of acid solutions containing peroxymonosulphuric acid instead of hydrogen peroxide, the problem of active oxygen compound decomposition is markedly and significantly reduced to a tolerable level.

In fact, when the peroxycompound is decomposed only very slowly, it tends to result in the presence of dissolved oxygen in the leaching solution rather than in the production of gaseous oxygen bubbles. This dissolved oxygen can also be employed slowly by the leaching liquor for the oxidation of tetravalent uranium to the soluble hexavalent uranium. In consequence, use of solutions according to the present invention has the advantages of minimising the problems of blinding and loss of permeability of the ore and ores and beyond that, enabling the leach liquor to retain its oxidant capability for a far longer period underground so that oxidant-containing leach liquor can penetrate through to the zone around the recovery well and thereby obtain a more complete extraction of uranium. By retaining the active oxygen-containing compound in solution for a far longer period, a greater proportion of the oxidant is delivered to where it can perform the useful oxidation of tetravalent uranium to hexavalent so that the process of the instant invention is less wasteful in the use of active-oxygen than is the comparable process employing hydrogen peroxide.

The pregnant leach liquor extracted from the recovery wells is then passed to apparatus for the removal of uranium. The conventional methods which have been described for the recovery of uranium from acid liquors can conveniently be employed in respect of leach liquors obtained by the instant process, and such methods include passage of the liquor through an ion exchange column and solvent extraction by contacting the liquor with a suitable organic amine dissolved in an inert solvent. Subsequent stages in the work-up can naturally employ the techniques that are described in the art.

Although it is possible for the leach liquor to be discarded after its content of uranium has been removed, it is preferable for at least a part of the liquor to be recycled. In such processes, the leach liquor is recycled in a cycle comprising the steps of:

(i) passage through the ore body
(ii) recovery of uranium from the leach liquor;
(iii) make up of the leach liquor and recycle of the liquor to step (i), wherein the peroxymonosulphuric acid is introduced into the leach liquor in step (iii), desirably to within the aforementioned ranges of concentration, and preferably the concentration of peroxymonosulphuric acid is restored to its original level.

When the leach liquor solutions are recirculated, they often contain after several circuits significant quantities of other transition metals such vanadium, iron, chromium, cobalt, nickel or molybdenum when these metals are present in the uranium containing ores. Thus an active-oxygen containing oxidant which is introduced into the leach liquor comes into contact with the catalytically destructive metal ions even before it reaches the ore body which would, thereby, in the case of hydrogen peroxide result in immediate and significant loss of oxidant that does not occur to anything like the same extent when peroxymonosulphuric acid is used instead.

The peroxymonosulphuric acid for use in the present invention can be prepared conveniently by reaction between hydrogen peroxide, preferably having a concentration of at least 50% and often from 70–75% w/w, and either concentrated sulphuric acid, normally at a concentration of above 90%, or oleum, often oleum containing up to 30% excess $SO_3$. By choosing an appropriate ratio of hydrogen peroxide to $SO_3$ moiety and concentrations of each it is possible to obtain a solution having the desired ratio of sulphuric acid to peroxymonosulphuric acid either for use after dilution with water as the liquor or for introduction into recycled leaching solution to restore the acid concentrations to the desired levels. Alternatively the peroxymonosulphuric acid can be produced by the other conventional method, namely the electrolysis of sulphuric acid (forming peroxydisulphuric acid) followed by hydrolysis to peroxymonosulphuric acid.

In such respects as methods of completing wells, the spacing and pattern of the wells and residence time of the leaching liquor underground, it will be understood that the instant invention process can employ such methods, arrangements and times as have been disclosed or used in respect of sulphuric acid processes for in situ mining of uranium. Thus, by way of example, the spacing of the recovery well from the injection well is often in the range of 3 to 30 meters and a conventional 5 or 9 spot pattern is eminently suitable. Residence time for the leaching solution is typically not longer than the range of 6 to 20 days, and can even in some cases be a matter of hours, but it will be recongised that the pressure at which the liquor is injected can be somewhat less, if desired, employing a peroxymonosulphuric acid solution than when employing a sulphuric acid solution containing a corresponding amount of hydrogen peroxide initially, or most desirably that the concentration of peroxymonosulphuric acid can be less to achieve the same rate of exhaustion as using hydrogen peroxide. Also, in view of the stability of peroxymonosulphuric acid, the temperature of the injected leaching solution can initially be up to its boiling point, particularly in the range of 5° C. to 90° C. In practice, since the leaching solution rapidly reaches a temperature in the equilibrium with that of the ore body with which it comes into contact, the initial temperature is normally in the range of 5° to 35° C.

By way of example of the present invention and in demonstrating the enhanced stability of the leaching solution according to the instant invention in comparison with an equivalent hydrogen peroxide containing solution, solutions were made up containing various concentrations of vanadium, which is a typical catalytic metal for the decomposition of active oxygen containing compounds. In example (1) and comparison (1), the concentration of vanadium ion in solution was 0.06 g/l and in example (2) and comparison (2) the concentration of vanadium was 0.6 g/l. In both of the examples, and both of the comparisons, the vanadium containing solutions were prepared by dissolving vanadyl sulphate in demineralised water and thereafter in the examples an appropriate amount of peroxymonosulphuric acid was added and in the comparisons an appropriate amount of hydrogen peroxide was added, to provide in each case a concentration of about 0.045 moles per liter of active-oxygen containing compound. In the case of peroxymonosulphuric acid, this was approximately 1.5 g/liter and for hydrogen peroxide approximately 0.5 g/liter. The solutions were then stored at ambient temperature (25° C.) and the active oxygen content of the solutions measured by the standard methods at the times shown in Table 1 below. The active oxygen content of the solution was then compared with its original content and the result expressed as a percentage.

The figures shown in Table 1 are an average of several runs.

TABLE 1

| Example/Comparison | % Active oxygen remaining in solution after time (hours) | | | | |
|---|---|---|---|---|---|
| No. | 2 | 28 | 96 | 192 | 480 |
| Ex 1 | 86 | 82.5 | 80 | 74 | 54 |
| C1 | 0 | 0 | 0 | 0 | 0 |
| Ex 2 | 88 | 76 | 60 | 49 | 27 |
| C2 | 0 | 0 | 0 | 0 | 0 |

From Table 1 above it can be seen that a significant proportion of the peroxymonosulphuric acid remains even at the end of the period of from 2 hours to 20 days which covers the typical residence times of solutions in 'in situ' leaching, with an average loss in Example 1 of only 2.3% per day and in Example 2 of 3.6% per day. In comparison, no hydrogen peroxide at all could be detected in either of the hydrogen peroxide containing solutions when an analysis of the solutions were made after only 2 hours. This confirms the visual observation that gas was being evolved rapidly when the hydrogen peroxide was added to the vanadium solutions. This clearly demonstrates the enhanced stability of the peroxymonosulphuric acid solutions in the presence of amounts of transition metal ions typically encounterable in underground uranium leaching liquors.

The permeability of ore to leaching solution can be tested in the laboratory under accelerated conditions either by monitoring the pressure needed to maintain a given flow leaching solution through a sample of ore packed in a column or by monitoring the flow obtained when the solution is passed through the ore under a given constant pressure. Any decrease in permeability, for example that caused by the formation of oxygen bubbles by the decomposition of the oxidant, which of course manifests itself by respectively an increased pressure requirement or a decreased flow rate, normally occurs within half an hour to an hour after the test has started, i.e. after introduction of the oxidant to steady state conditions. The test represents a means by which leaching solutions can be ranked as to their effect on permeability of an ore, by carrying out the test using identical apparatus and the same conditions.

When the permeability tests are carried out on samples of uranium containing ore characterised by containing only a small amount of acid-consuming gangue and a significant amount of minerals containing transition metals as described herein that catalytically decompose peroxygen compounds and in which most of the uranium is in a tetravalent state, employing at ambient temperature leaching liquors having an acidity of approximately pH 1.0 and an oxidant concentration of 0.02 moles per liter, it is found that the permeability of the ore remains at a level that is higher where the oxidant is peroxymonosulphuric acid than when it is hydrogen peroxide, thus demonstrating the beneficial effect of employing peroxymonosulphuric acid.

A further demonstration of the beneficial effects of employing $H_2SO_5$ as oxidant in 'in situ' leaching can be seen from a laboratory extraction using an ore containing 0.12% uranium and several transition metals capable of catalysing hydrogen peroxide including 0.41% iron and 0.020% vanadium, and 0.017% molybdenum. Two samples of the ore each of 20 g were each contacted at ambient temperature (25° C. approx) with a dilute sulphuric acid solution (200 mls) having a typical concentration of 5 gpl $H_2SO_4$ for in situ leaching, ore containing 0.235 gpl $H_2SO_5$, i.e. a mole ratio of $H_2SO_5$ to $H_2SO_4$ of 1:25 and the other 0.07 gpl $H_2O_2$, i.e. a mole ratio of $H_2O_2$ to $H_2SO_4$ also of 1:25. The uranium content of the solution was measured periodically and by comparison with the analysed content of uranium in the ore, the percentage extraction calculated. The results are summarised in Table 2 below.

TABLE 2

| Leach time | % Uranium extracted employing | |
|---|---|---|
| hours | Hydrogen Peroxide | Peroxymonosulphuric acid |
| 1 | 26 | 30 |
| 2 | 41 | 61 |
| 3 | 54 | 68 |
| 4 | 62 | 79 |
| 5 | 63 | 81 |
| 6 | 64 | 86 |
| 7 | 65 | 87 |

From Table 2 it can be seen that the hydrogen peroxide solution was levelling out at about 65–70% extraction whereas the peroxymonosulphuric acid solution was levelling out at about 87–90% extraction, i.e. about 20% higher. Moreover, throughout the rate of extraction was higher when peroxymonosulphuric acid was employed than when hydrogen peroxide was employed.

I claim:

1. In a process of in-situ leaching of a uranium ore in the ground, which comprises the steps of:

(a) drilling at least one injection well and at least one production well offset from the injection well into an ore body located underground containing uranium and at least one transition metal;

(b) injecting an acid leaching solution containing sulphuric acid and an oxidant into the uranium-containing ore body through the injection wells;

(c) recovering from the production wells a leach liquor containing dissolved uranium salts formed by passage of the leaching solution through the uranium-containing ore body; and (d) recycling the leach liquor in a cycle comprising the steps of:

(i) passage of the leach liquor through the ore body (ii) recovery of uranium from the leach liquor;

(iii) make up of the leach liquor and recycle of the liquor to step (i), said uranium ore containing significant amounts of a transition metal that acts as a catalyst for peroxidant decomposition;

the improvement which comprises:

utilizing peroxomonosulfuric acid as said oxidant in said acid leaching solution; and introducing said peroxomonosulfuric acid to the process by feeding said peroxomonosulfuric acid with said leach liquor in said step (d) iii.

2. A process as claimed in claim 1 wherein the peroxymonosulphuric acid is introduced in a mole ratio to the sulfuric acid in the range of 1:1 to 100.

3. A process as claimed in claim 2 wherein the amount or peroxymonosulphuric acid introduced is within the range of 0.0005 to 0.1 moles per liter of leaching solution.

4. A process as claimed in claim 1 wherein the leaching solution contains from 0.01 to 0.25 moles of acid per liter.

5. A process as claimed in claim 4 wherein the leaching solution contains from 0.025 to 0.075 moles of acid per liter.

6. A process as claimed in claim 4 or 5 wherein the amount of peroxymonosulphuric acid introduced is within the range of 0.001 to 0.03 moles per liter of leaching solution.

7. A method according to claim 1 wherein said transition metal comprises vanadium.

* * * * *